United States Patent [19]

Homuth

[11] 4,207,802

[45] Jun. 17, 1980

[54] HYDRAULIC CYLINDER WITH IMPROVED DASHPOT AND PORTING

[76] Inventor: Kenneth C. Homuth, 1885 E. Old Shakopee Rd., Bloomington, Minn. 55437

[21] Appl. No.: 893,284

[22] Filed: Apr. 5, 1978

[51] Int. Cl.[2] ..... F15B 15/22

[52] U.S. Cl. ..... 91/405; 91/409

[58] Field of Search ..... 91/409, 408, 405, 25, 91/392, 407; 92/85 B; 188/285, 287

[56] References Cited

U.S. PATENT DOCUMENTS

| | | | |
|---|---|---|---|
| 2,974,643 | 3/1961 | Gillham et al. | 91/405 |
| 3,425,498 | 2/1969 | Bick | 91/409 |
| 3,568,571 | 3/1971 | Hoen et al. | 91/405 |
| 3,626,812 | 12/1971 | Trick | 91/408 |
| 3,776,100 | 12/1973 | Yeh | 91/409 |

FOREIGN PATENT DOCUMENTS

| | | | |
|---|---|---|---|
| 1400052 | 7/1975 | United Kingdom | 92/85 B |

*Primary Examiner*—Paul E. Maslousky

[57] ABSTRACT

Apparatus is disclosed for an improved hydraulic piston and cylinder design wherein grooves in the piston surface create a dashpot effect at the respective ends of piston stroke and assist hydraulic oil porting into the cylinder for improved response during stroke reversal, where the piston at least partially covers the cylinder oil flow port.

5 Claims, 5 Drawing Figures

HYDRAULIC CYLINDER WITH IMPROVED DASHPOT AND PORTING

BACKGROUND AND SUMMARY OF THE INVENTION

The present invention is related in some respects to the invention disclosed in my U.S. patent application No. 659,127, filed Feb. 18, 1976, now U.S. Pat. No. 4,086,844 and entitled "Hydraulic Cylinder Utilizing Corrugated Running Surfaces." Reference also is made to my U.S. Pat. No. 4,072,434, issued Jan. 24, 1977, and entitled "Hydraulic Cylinder With Concentrically Maintained Piston and Rod," as it applies to pistons "bottomed" at either terminal end of the cylinder stroke.

Aside from advantages previously described in application of a corrugated running surface on the circumference of hydraulic cylinder pistons in general, it is of particular importance here that the cross-sectional profile of the surface show a unique combination of three characteristics:

(a) Little, if any reduction of total piston bearing surface. While the corrugated surface valleys result in a unit area bearing surface reduction of approximately 20%, a greater total circumferential piston surface is made available in the preferred surface-seal embodiment of the present invention over that of typical piston circumferential bearing surfaces.

(b) A substantial sub-surface hydro-dynamic fluid flow capability that approaches full port flow requirements in the terminal piston positions.

(c) A surface interruption so minimal as to still provide adequate anti-extrusion support for elastomeric or relatively soft piston-bore seals in circumferential grooves adjacent to or intermediately located in the corrugated piston surface.

The design significance of this unique combination of characteristics is that it affords the opportunity to eliminate the typical, axial length wasting, cylinder port dashpot provisions at both cylinder stroke ends, thereby to accommodate their fluid flow purposes tangent to and within the axial length of the piston itself, by utilizing the hydro-dynamic flow capability of normal piston-bore clearances as supplemented by the corrugated surface applied to the piston circumference, in conjunction with a basic sidewall cylinder porting approach.

The prior art term "dashpot" as herein used means "protected area adjacent to a cylinder port orifice, whose purpose is to provide an open fluid flow path between a port orifice and its associated piston pressure face when the piston is in a terminal or stroke end position." The typical "dashpot" results from prevention of piston surface interference with the port orifice by means of counterbores, step diameter hubs, piston stroke stops, etc. This is in direct contrast to application of the present inventive surface of the piston circumference whereby the piston bearing surface is deliberately allowed to contact, cover, or overlap side wall port orifices at either terminal end of the cylinder stroke, with the following advantages:

(a) a general reduction in cylinder costs through base end plate and cylinder head simplification by elimination of porting dashpot consideration in these components;

(b) a much wider range of "standard" base end plate-piston-head applications in short, medium and long length cylinders;

(c) a substantial reduction of cylinder "dead length;"

(d) a more universal use of simple "side wall" porting; and (e) greatly expanded potential use and improved performance of typical side wall cushions at the stroke terminal ends and elimination of the need for secondary "out of cushion" circuits, in such cushions or stroke dampening designs; the latter elimination becoming even more of an advantage by incorporation of a "single directional sealing piston ring" as explained herein, but which is not integral to the present invention.

Hydraulic cylinders typically have two "dashpotted" ports to affect cylinder extension and retraction. These ports are located at the approximate terminal ends of the cylinder or piston strokes. Each port alternately affects a fluid input orifice for energizing one stroke direction and acts as an exhaust orifice for fluid being expelled by the piston in the opposite stroke direction. It then follows that the "base end" port affects cylinder extension and retraction exhaust, with the "rod end" port affecting cylinder retraction and extension exhaust. Base end porting has been affected through the base end plate in countless variations, which have limited application in space critical instances. In any case, base end plate porting involves a more complex end plate configuration than the simple circular disc end plate adequate for use with the invention. This is particularly true if the end plate also houses a "plunger" type base end hydraulic cushion and/or a secondary "out of cushion" full velocity circuit, which is unnecessary with the invention. Most generally, base end porting has been affected simply by welding a port or port tube over an orifice in the cylinder case. This orifice is located immediately forward from the cylinder internal face of the base end plate, and thereby utilizes a typical axial length wasting dashpot area created by a typical, projecting, piston retaining nut on the base end plate side of the piston; the nut projection prevents piston-orifice overlap, since the nut thickness is normally, approximately the same thickness as the port orifice diameter. For space conservation purposes, a nut recessing counterbore has at times been provided in the base end plate, with porting then accomplished through the end plate. While this may allow the piston itself to bottom against the end plate, as a space savings, it also results in loss of space through a thicker than otherwise required end plate, with more material, weight and end plate complexity over that required by the present invention. In other instances, the piston retaining nut has been recessed by a counterbore into the "backside" of the piston. Welded and threaded piston-rod unions have been used that eliminate the piston nut and its recessing counterbores, and in which the piston can also either bottom or approximate that position. The invention described in my U.S. Pat. No. 4,072,434 is one of these. In many cases, where the piston approximates contact with the base end plate, either end plate porting is used or the piston diameter may be machined back as a reduced diameter hub (dashpot) for a sufficient distance to prevent the piston surface or piston seal contact with a sidewall port orifice, but this obviously reduces both potential piston bearing area and overall cylinder bearing span and makes pointless the nut counterbore. Another choice has been to retain full piston bearing length in conjunction with a positive, centrally located, soft piston seal and to deliberately piston surface block a sidewall port orifice in the terminal piston position, while ignoring its flow performance effect. The basic difference between this concept and the present invention is that, absent the inventive piston surface, performance is unacceptable as a universal design approach and should be restricted to known low performance instances primarily because of excessive heat generation and slow initial reverse stroke response, until the piston moves clear of the orifice.

Rod end porting has also had many variations. Typical cylinders have a removable end cap that is in some manner attached to the cylinder case. The end cap provides a sliding bearing journal for rod support in stroke reciprocation, houses seals to prevent outboard fluid leakage between the rod and its journal, contains outside diameter (O.D.) seals to prevent fluid leakage through the capcase junction, and incorporates some means to retain the end cap to the cylinder case. Historically this end cap has been called a cylinder "gland" or "head gland," perhaps because in many instances retract cycle hydraulic fluid has been fed into the cylinder directly through this member, thereby also creating a more complex head because of the internal porting and flow patterns required. At times this has also involved a dashpot counterbore in the piston contact face of the head or gland; this obviously reduces otherwise available rod journal bearing area. Another approach has been to port through the case in a head-case overlapped dashpot area formed by a reduced diameter hub of the head. This has limited application in that it limits the available length to accommodate a case-head seal and to retain the head-case union; this is especially critical if internal case threads are used to retain the head. Such threads obviously consuming more axial length than a lighter duty snap ring which is limited to relatively low hydraulic system pressure ranges. Another approach has been to create a dashpot in the rod side of the piston circumferential surface, by affecting a reduced diameter hub of a length approximately the axial length of the rod end port orifice diameter. This generally does not critically limit piston bearing area in relatively short cylinders and has no effect on overall cylinder bearing span. In medium to long length cylinders, some form of piston stop, stop tubes, etc. are generally used to further axially separate the head and piston bearing surfaces, thereby maintaining a reasonable bearing span to extended length relationships for adequate minimum bearing loads. The stop tubes also provide a "natural," otherwise wasted, potential dashpot length that can be utilized by the retract port orifice without affecting head or piston configurations. No claim is made here that the present invention eliminates stop tubes or the need of increased bearing span in medium to long stroke cylinders, but its incorporation into the piston bearing surface accomplishes an adequate dashpot function within the piston bearing surface itself while full length piston-cylinder bore bearing contact is accomplished. Porting and dashpot provisions therefore have no part in base end plate or head end cap design consideration; these components are then reduced to simpler basic forms and minimum possible "dead length" or "no stroke" combinations. The piston, therefore, with its greater possible bearing length and relatively full flow surface is capable of application over a much wider range of stroke length situations in "standard " piston forms and fewer stop tube required instances. A greater range of standards application, in itself, represents great overall cost savings.

While the corrugated surface, applied to the piston circumference, can eliminate otherwise-provided dashpot areas, its incorporation for that purpose is also a result of some directly associated observations:

(a) typical dashpot functions are of relatively short time-length consideration, relevant only to the ends of cylinder strokes, and intended simply to prevent piston-port orifice flow interference, in the terminal piston positions;

(b) hydraulic cylinder pistons generally are of somewhat greater length or thickness than the combined axial length of their typical two port orifice diameters; this provides the possibility of complete piston-side-wall port orifice overlap at both ends of the cylinder with enough residual axial piston length to accommodate a single, centrally located, double acting, elastomeric seal member, the combined axial length of the two port diameters representing the approximate minimum potential length savings;

(c) while common cylinder case ovality, local portcase weld distortion and high cylinder side loadings, etc., would drastically affect the already severely restricted flow of the proposed piston covered orifice, absent the inventive surface, these have little effect on average circumferential clearance between the piston bearing surface and the cylinder bore;

(d) there is a "conveniently" close relationship between the cross sectional area, hydro-dynamic flow potential of average piston-bore clearances and their associated port flow requirements in the terminal piston position; it is also conveniently true that the larger the cylinder bore, the larger the port orifices and the greater the piston bore clearances which the inventive surface greatly supplements in added fluid flow capacity.

For purposes of describing the present invention the term "sidewall cushioning" is intended to mean: a method of cylinder stroke velocity deceleration accomplished by by the piston O.D. surface being allowed to cover-restrict its fluid exhausting sidewall port orifice at and near the terminal end of the stroke. It two primary advantages over "plunger" type cushion forms, are in conservation of cylinder axial length and potential elimination of secondary "out of cushion" circuits typically required, since its purpose is accomplished by mere piston-port orifice overlap, as with the aforementioned inventive piston surface dashpot. Its normal piston seal configuration also includes a single bi-directional resilient sealing member in a piston circumferential groove located central to the piston O.D. surface or far enough inboard from the leading piston edge to prevent its extrusion into the port orifice, at the terminal piston position. The differentiation here between general dashpot and specific sidewall cushion purposes may be fine line, dependent on the extent of piston-orifice overlap length and more particularly on the exclusion or inclusion of a fluid metering piston ring, as described below. The effect of the corrugated surface in this is to greatly increase piston blocked orifice fluid flow, to the advantage of both dashpot and cushion purposes. For more positive sidewall cushion results, the central piston seal is often supplemented by a "non-extrudable," overlap jointed metallic ring in a piston circumferential groove near the leading edge of the piston; the ring becoming the primary orifice flow closing medium. The metallic ring has more positive fluid metering characteristics than the piston surface itself, allowing a more controlled stroke deceleration by better control of by-passing cushion area fluid flow to the exhausting orifice being blocked. The term "fluid metering" ring, used above, refers to the characteristic fluid by-pass of common available metallic rings, here adequate to the desired fluid metering cushion flow effect, not to any special fluid metering types. While a cylinder cushion's primary function of stroke velocity deceleration is accomplished by exhaust flow restriction, this is also a process of heat generation, more effectively dissipated by the sidewall type, over that of the plunger, simply by its greater total cooling surface exposure, and here aided by the inventive surface valleys. A secondary, but critical, requirement of cylinder cushions, of either type, is that stroke deceleration be accompanied by a reasonably instant "out of cushion" full, reverse stroke velocity, in which the "plunger" virtually requires a secondary "starter circuit" a space and cost consuming, typical check valve arrangement incorporated into either or both the base end plate or the cylinder head. While the previously described fluid metering ring obviously also retards reverse stroke velocity, the corrugated surface performs as an intermediately located dashpot and assures a greater volume of instant reverse or free fluid to the circumferential inner face of the metallic ring; the combination providing adequate reverse stroke velocity under many circumstances that otherwise would have required secondary circuits for adequate requirements. Maximum "in and out" of cushion performance can be realized without resort to secondary circuits and within the described piston configuration, by simple substitution of the previously described metallic piston ring for a "single directional sealing ring," also in conjunction with a corrugated piston surface. The single sealing ring performs in conventional manner in one piston direction and permits virtual free fluid flow in the opposite direction, as a one directional flow metering check valve, but is not part of the present invention.

In summary of the foregoing discussion, there are two general corrugated piston surface preferred embodiment forms to accomplish the dashpot cushion purposes:

(1) Basic single seal, the seal located in a piston circumferential groove relatively central to the two piston faces and flanked on one or both sides by the corrugated surface configuration.

(2) Universal or multiple seal, a variation of the basic in which the central seal must be elastomeric and is supplemented by a metallic seal in a groove near either or both piston faces, with the corrugated surface configuration located intermediate the seals, on one or both sides of the central seal.

No claims are made here on the individual seals involved or in their combinations, but rather in their compatible combinations with the corrugated surface for the space saving and fluid flow improvements within the piston circumferential surface, for cylinder porting dashpot and cushion purposes.

It is of unique cylinder design significance that the present invention:

(1) can accommodate the cylinder porting dashpot purposes at either or both cylinder ends within the axial length of the piston circumference;

(2) allows the same surface configuration to satisfy all performance requirements of a cylinder cushion at either or both cylinder ends;

(3) allows both dashpot and cushion functions to be simultaneously accomplished within the same piston surface configuration; and (4) results in either or both dashpot and cushion functions accomplishment in a simpler more economical form and in less cylinder axial length than any prior art design of equal bearing span.

The herein accomplished objective of the corrugated surface has been to affect a piston surface configuration adequate to cylinder dashpot, cushion flow requirements, without significant reduction of cylinder bearing or antiextrusion support for intermediately located piston seals. The emphasis here is utilizing the hydrodynamic fluid flow capabilities of the corrugated surface rather than the surface hydro-static advantages of the prior art.

While the basic angled, parallel valley, corrugated surface will greatly improve fluid flow between the blocked port orifice and the piston surface, in any case, the full here described "circumferential-cross flow" effect is realized simply by adding one or more auxiliary piston circumferential grooves intermediate or adjacent the surface pattern, as part of the pattern. The auxiliary grooves are spaced so as to accomplish and maintain "double ended" intersection with the port orifice during the terminal, piston-orifice blocking portion of the stroke. The "grooves" here perform as "collector rings" circumferentially joining the corrugated surface valleys, thereby affecting a more positive piston circumferential flow union between the "blocked" port orifice and the pressure face of the piston, regardless of and in addition to piston-bore clearances, and in addition to the lesser flow "joining" effect provided by the adjacent seal ring grooves themselves. It is preferred that any added auxiliary grooves be of rectangular cross section-relatively narrow and deep, so as to cause minimum reduction of piston bearing surface. Considering the double flow ends of the groove affected by intersection with the port orifice, total flow groove end exposure should equal or exceed the cross sectional area of the corrugated surface valleys. For example:

A 6" diameter corrugated piston surface of typical parallel "V" shaped valleys with the "V" shaped valleys spaced at preferred 12 to 14 per piston circumferential inch, and approximately 0.015 deep, the total valley cross sectional area roughly equals 0.035 in.$^2$.

This is approximately equal to a single, port orifice intersecting, auxiliary groove 1/16" wide×5/16" deep. The resulting blocked orifice piston circumferential crossflow is approximately 30 gallons per minute (GPM) at 1,000 pounds per square inch (psi), or half normal system pressure, which is adequate for normal dashpot-cushion requirements even if no actual piston bore or piston orifice clearance existed.

As a rule of thumb, the prescribed corrugated surface valleys create an added piston surface cross flow capability roughly equivalent to 50% of average piston-bore clearances or to an equivalent 3/32" diameter orifice per inch of piston diameter. If desired or as required, this flow can be circumferentially joined and orifice intersected by a single auxiliary groove of ½ the surface valley total cross sectional area, since such intersection doubles the auxiliary or collector groove flow exposure. Correspondingly, the corrugated surface cross flow of a 12" bore cylinder piston can be circumferentially joined and orifice intersected by a single 1/16" wide × ⅜" deep groove. Ignoring all positive variable piston bore clearances, seal ring groove collections and local orifice area diffusion flow, the resultant circumferential cross flow of the "surface" alone should be adequate to any dashpot-cushion flow requirements. Beyond suggested variation, no attempt is made here to include or define auxiliary circumferential flow grooves. The purpose has been to illustrate that in conjunction with previously prescribed combinations of piston-bore seals, the present corrugated surface invention offers a unique basic means to a positive "fluid flow" system between a piston blocked sidewall port orifice and the pressure face of the piston, by way of a simple, expanded circumferential-cross flow in the parent piston bearing surface itself, regardless of orifice overlapped length and local piston-orifice, and piston-bore clearances. This is not to say that clearance variations will not vary flow, only that adequate hydrodynamic flow capability is assured in the overlapped piston-port orifice position by incorporation of the invention surface. Whatever resulting flow restriction, from overlap, is of short time duration and any resultant heat generation is effectively dissipated over the "flute cooled" piston circumference, rather than concentrated at the piston-orifice junction. In this regard, when using the "surface" for piston dashpot purposes, if severe full stroke cycling might be experienced and particularly if the more positive fluid restrictive sidewall cushioning is to be used. . . it is advantageous to select a piston material with high heat conduction properties, such as aluminum. Aluminum is particularly compatible with "the surface," since it also easily accepts application of the surface by a variety of optional high speed rolling or maching processes... and the surface eliminates the objectionable stroke cycling "screech harmonic" tendency commonly associated with sliding journal applications of direct bearing aluminum.

BRIEF DESCRIPTION OF THE DRAWINGS

A preferred embodiment of the invention is described herein, with reference to the appended drawing, in which.

DESCRIPTION OF THE PREFERRED EMBODIMENT

Figure 1:
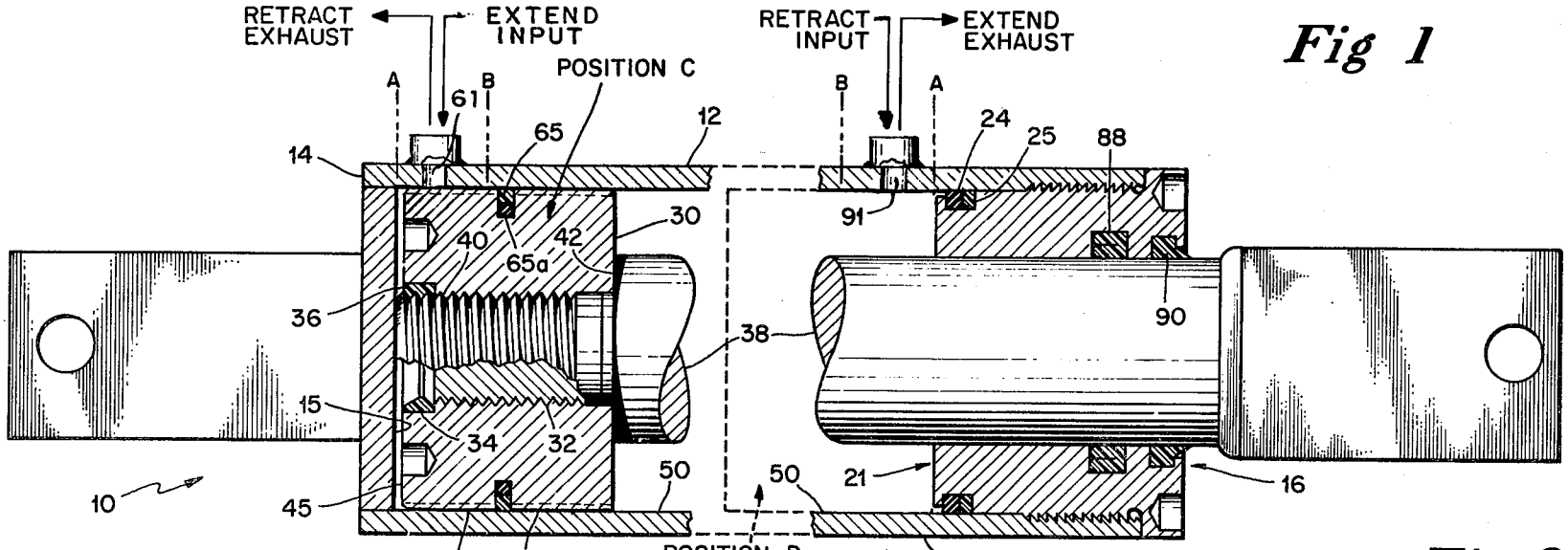
FIG. 1 is a side view in cross section of a cylinder and piston assembly incorporating the inventive features.
Figure 2:
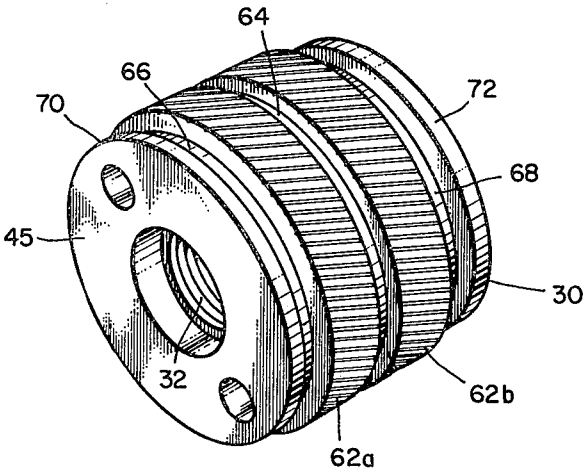
FIG. 2 is an isometric view of an embodiment of a piston for use as a part of the invention.
Figure 3:
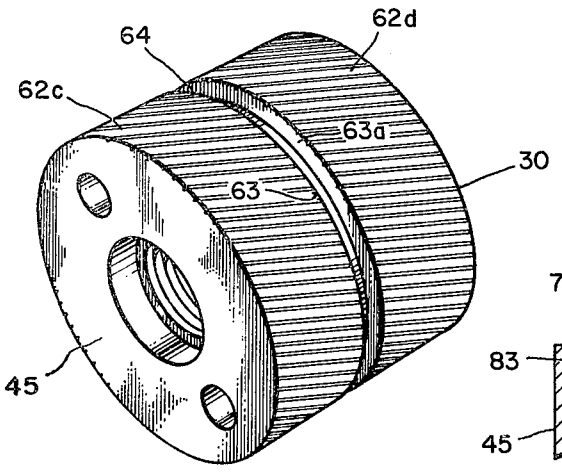
FIG. 3 is an isometric view of a second piston embodiment.

Referring first to FIG. 1, there is shown in side view and cross section a cylinder and piston assembly 10 incorporating the inventive features. The piston 36 is threaded via threads 32 to a connecting rod 38 in a manner described in my U.S. Pat. No. 4,072,434, which includes locking member 34, and is fitted within cylinder 12 according to conventional manufacturing practices. A head 16 is threaded into cylinder 12 by means of threads and suitable fluid seals 88 and 90 prevent hydraulic fluid from leaking from the apparatus through the rod 38 bearing surface. Additional fluid seals 24 and 25 prevent leakage between cylinder 12 and head 16. Connecting rod 38 has a shoulder 42 which is tightened against piston face 30. The piston is shown in its fully retracted position C within cylinder 10, in which piston face 45 approaches contact with race 15 of end plate 14. The opposite relative position is indicated in dotted outline in FIG. 1, showing the piston in its fully extended position D, in which piston face 30 is in contact with head face 21. The effective double-bottomed piston constitutes a minimum cylinder dead length situation in that no dashpot axial length is consumed by orifices 61 or 91 regardless of their diameters, and neither end plate 14 nor head 16 requires such dashpot accommodation or configuration because the dashpot purposes are accomplished within the axial length of the piston itself. Orifices 61 and 91 may range in location from tangential contact with end plate face 15 and head face 21 (orifice position A), in the maximum flow dashpot attitude, to within approximately ⅛th inch, or reasonable anti-extrusion proximity, to central seals 65 and 65*a*, in the maximum sidewall cushion attitude (orifice position B). The intervening corrugated surfaces provide adequate dashpot flow for any desired primary purpose by merely varying the axial locations of the orifices between positions A and B. FIGS. 2 and 3 show general multiple and single seal piston surface forms respectively, recommended to accommodate the inventive piston surface dashpot cushion purposes. While FIG. 1 illustrates the piston of FIG. 3, either form may be used. The piston of FIG. 2 offers more positive sidewall cushion characteristics and greater shock pressure protection to central seal 65, by inclusion of rings in grooves 66 and 68. FIG. 3 offers the maximum bearing area potential with minimum flow restriction on stroke reversal from terminal piston positions C and D used with orifice positions approximating B, and lower costs in its simpler construction.

The pistons of FIGS. 2 and 3 also conform to the invention disclosed in my U.S. Pat. No. 4,072,434, in respect to the means of attachment of rod 38 to the pistons. The significance of this prior invention herein is that the space saving advantages of the corrugated piston surface dashpot are best realized by a piston-rod face 45 which can fit in approximate flush abutment with face 15 of end plate 14, in the base end terminal position C. This has no relevance, however, to improvements in sidewall cushion performance by use of the surface in non-flush bottomed piston circumstances. The corrugated surfaces of FIG. 2 and FIG. 3 are shown in their preferred embodiment, in the piston material itself rather than on independent bearing ring circumferences in order to permit maximum possible piston-bore bearing contact with maximum anti-extrusion support for central seal 65, and avoids possible thin wall bearing ring extrusion into overlapped port orifices, such as indicated by position B of FIG. 1, and which overlap is a central advantage of the present invention.

Figure 4:
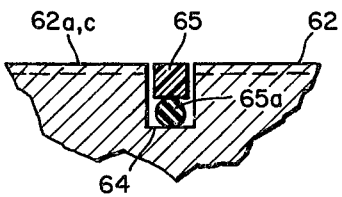
FIG. 4 is an expanded cross section of a seal and piston groove.

FIG. 4 is an expanded cross section showing seal 65 and its housing groove 64, which is relevant to both FIG. 2 and FIG. 3 pistons as the positive central piston seal member. Seal 65 consists of O-ring 65*a* and a square cross section backup or anti-extrusion member. No attempt is made here to specify or limit seal 65 other than to illustrate a proven elastomeric type which provides adequate, positive seal, wear and anti-extrusion characteristics in extremely limited axial length, thereby maximizing the available range of piston-orifice overlap or distance between variable orifice locations A and B.

Seal 65 ideally affects a minimum width circumferential line seal midway between piston faces 30 and 45 for maximum piston-orifice overlap opportunity.

Figure 5:
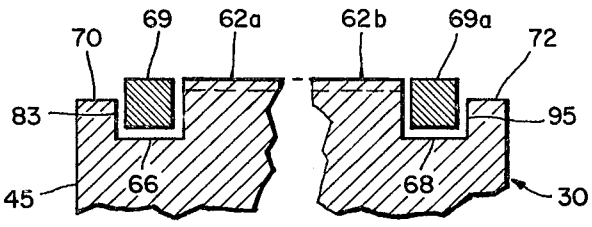
FIG. 5 is an expanded cross section showing piston and piston rings.

FIG. 5 is an expanded cross section showing piston rings 69 and 69*a* in grooves 66 and 68 respectively. As with seal 65, no attempt is intended herein to specify or limit rings 69 and 69*a* except that they should be lap-jointed rings of minimum width consistent with similar ring manufacturer's specifications for such purposes. In connection with rings 69 and 69*a*, ring lands 70 and 72 should be located as near as possible to the respective piston faces 45 and 30, with the ring land widths as narrow as possible consistent with required rim load strength so as to affect maximum possible distance between outboard groove faces 83 and 95 (FIG. 5). The diameters of ring lands 70 and 72 should be sufficiently less than that of surfaces 62*a* and 62*b* so as to prevent any possible contact with the cylinder bore 50 at all points of piston travel from end face 15 to head face 21. It should be noted that when using the piston of FIG. 2, some means should be provided to prevent contact between ring land 70 and end face 15, and between ring land 72 and head face 21. The reason for this is, if the bottomed respective faces are not perfectly parallel at contact, the ring lands may be distorted, resulting in poor ring performance or actual jamming of rings 69 and 69*a*. This can be avoided in a variety of ways, such as the slight recess of the land 72 from the piston faces as indicated in face 30. The land recess or relief need be no more than 0.015–0.020 inches, with none needed in face 45 if some other minor rod or other projection is present to provide the relief between face 15 and face 45 as shown in FIG. 1.

In addition to existing piston-bore clearances, the corrugated piston surface valleys provide a positive and substantial hydro-dynamic flow factor between the terminal area fluid and the exhausting port orifices; as the piston approaches its terminal C or D positions, or as the leading piston edge exceeds contact tangency with and begins to cover the exhausting orifice, whether the leading edge is of ring 69, 69*a* in conjunction with surface 62*a*, 62*b* of FIG. 2, or surfaces 62*c*, 62*d* of FIG. 1 and FIG. 3. As shown in FIGS. 4 and 5, grooves 64, 66 and 68 provide lateral seal-groove clearances per normal manufacturing practices, the clearances between grooves 64 and 65 becoming an effective part of the flow system between the exhausting orifice and the terminal area fluid if exhaust fluid pressure exceeds system pressure as the piston is being driven toward position C or D; the driving force being a combination of system pressure and machine mechanical momentum. In this circumstance, seal 65 moves against the lower or system pressure side of its groove 64, thereby exposing its lateral clearance as a circumferential flow joining groove for the surface valleys and a greater exhaust orifice flow exposure. The same effect prevails on stroke reversal from terminal positions C or D, in which seal 65 moves against its input pressure opposite groove wall. This is obviously more significant the closer the orifices are located to their B positions, at which orifice positions ring 69 or 69*a* is forces to its outer groove face 83 or 95 respectively, under orifice input flow, with the related ring-groove clearances also aiding the circumferential flow characteristics.

Neither of the pistons of FIG. 2 or FIG. 3 affect significant stroke velocity reduction in reaching their respective C or D piston positions, using A locations for orifices 61 and 91, as for strictly dashpot purposes, and little reverse stroke response delay is experienced with the A orifice location. But as orifice locations are moved toward the B positions for a stroke dampening or cushion purposes, reverse stroke response becomes a factor for consideration as previously described. Also as previously described, the illustrated surfaces 62*a*, 62*b*, 62*c* and 62*d* are generally adequate to reverse stroke response requirements, but can be more fully utilized by adding previously described auxiliary circumferential grooves intermediate the surfaces. The auxiliary grooves provide a more direct piston circumferential flow intersection between the covered orifices and all surface valleys, the circumferential surface valley pattern providing the flute cooling cross flow for the pistons. As explained previously, when using the piston of FIG. 2 and orifice positions at or near position B, between seals 65 and 69 or 69*a*, maximum instant reverse stroke response can be realized either by a single directional sealing version of rings 69 and 69*a*, or seal grooves 66 and 68 may be cross-drilled to their respective near piston faces 30 and 45, thereby completely eliminating any need or purpose of secondary check valved starter circuits previously referred to.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. In a hydraulic cylinder and piston combination which includes a piston and cylinder and has respective hydraulic flow ports proximate the cylinder ends, the improvement comprising each of said ports having a respective predetermined cross sectional area and being positioned in a cylinder side so as to become at least partially blocked by the piston having a pattern of off-axis inclined grooves extending around the piston bearing surface circumference such that at least several of said grooves are in open and direct flow communication with a respective port as the piston at least partially blocks the respective port; and a circumferential groove about said piston intersecting said pattern along a circumferential line located such that said respective port is intermediate said line and one of said cylinder ends when said piston is at said piston stroke end, the circumferential groove providing flow communication between all of said off-axis inclined grooves, whereby hydraulic damping of said piston and piston stroke reversal is provided.

2. The improvement of claim 1, wherein the sum of the cross-sectional areas of said off-axis inclined grooves is approximately equivalent to an orifice area of 0.006 square inches per inch of piston diameter.

3. The improvement of claim 1, wherein the cross sectional area of said circumferentially extending groove is rectangular, having a depth greater than the width.

4. The improvement of claim 3, wherein the cross-sectional area of said circumferential groove is substantially equal to ½ of the sum of the cross-sectional areas of said off-axis inclined grooves.

5. The improvement of claim 2, wherein said piston is constructed of aluminum.

* * * * *